US010617596B2

(12) United States Patent
Downare

(10) Patent No.: US 10,617,596 B2
(45) Date of Patent: Apr. 14, 2020

(54) MASSAGE AND EXERCISE ROLLER

(71) Applicant: Taggart D. Downare, Sartell, MN (US)

(72) Inventor: Taggart D. Downare, Sartell, MN (US)

( * ) Notice: Subject to any disclaimer, the term of this patent is extended or adjusted under 35 U.S.C. 154(b) by 906 days.

(21) Appl. No.: 15/243,116

(22) Filed: Aug. 22, 2016

(65) Prior Publication Data

US 2017/0065482 A1 Mar. 9, 2017

Related U.S. Application Data

(63) Continuation-in-part of application No. 29/540,399, filed on Sep. 24, 2015, now Pat. No. Des. 765,871.

(60) Provisional application No. 62/214,491, filed on Sep. 4, 2015.

(51) Int. Cl.
*A61H 15/00* (2006.01)

(52) U.S. Cl.
CPC ..... *A61H 15/00* (2013.01); *A61H 2015/005* (2013.01); *A61H 2015/0014* (2013.01); *A61H 2201/0153* (2013.01); *A61H 2201/0157* (2013.01); *A61H 2201/1261* (2013.01); *A61H 2201/1284* (2013.01); *A61H 2201/164* (2013.01); *A61H 2201/169* (2013.01); *A61H 2201/1635* (2013.01); *A61H 2205/04* (2013.01); *A61H 2205/062* (2013.01); *A61H 2205/081* (2013.01); *A61H 2205/088* (2013.01); *A61H 2205/102* (2013.01); *A61H 2205/106* (2013.01); *A61H 2209/00* (2013.01)

(58) Field of Classification Search
CPC ..... A61H 15/00; A61H 2205/106; A61H 2205/088; A61H 2205/102; A61H 2205/04; A61H 2205/081; A61H 2205/062; A61H 2209/00; A61H 2015/0014; A61H 2201/169; A61H 2201/164; A61H 2201/1635; A61H 2201/1284; A61H 2201/1261; A61H 2015/005; A61H 2015/0007; A61H 2015/0021; A61H 2015/0028; A61H 2015/0035; A61H 2015/0042; A61H 2015/0057; A61H 15/0078; A61H 15/0085; A61H 15/0092; A61H 15/02; A63B 21/4035; A63B 5/20; A63B 22/20; A63B 23/02
See application file for complete search history.

(56) References Cited

U.S. PATENT DOCUMENTS 1,722,866 A * 7/1929 Snyder ..... A61H 15/00 601/121
1,850,862 A * 3/1932 Boyd ..... A61H 15/00 601/121
1,962,971 A * 6/1934 Schipper ..... A61H 15/00 601/121
2,546,095 A * 3/1951 Gustlin ..... A61H 15/02 601/121

(Continued)

*Primary Examiner* — Tu A Vo

(57) ABSTRACT

A massage and exercise roller has a left-end roller section, a left MFR section, a left-intermediate roller section, a central MFR section, a right-end roller section, a right MFR section and a right-intermediate roller section. The left-end roller section, the left-intermediate roller section, the right-intermediate roller section and the right-end roller section are formed into ellipsoid bodies. The left MFR section, the central MFR section and the right MFR section form negative space of joining ellipsoid bodies.

2 Claims, 7 Drawing Sheets

(56) References Cited

U.S. PATENT DOCUMENTS

| | | | | | |
|---|---|---|---|---|---|
| 3,548,814 | A * | 12/1970 | Montgomery | A61H 15/00 | 601/118 |
| 3,662,748 | A * | 5/1972 | Thurman | A61H 15/00 | 601/121 |
| D253,373 | S * | 11/1979 | Celeste | 601/121 | |
| D255,835 | S * | 7/1980 | Bentsen | D24/212 | |
| 4,378,007 | A * | 3/1983 | Kachadourian | A61H 15/00 | 482/79 |
| 4,712,539 | A * | 12/1987 | Kim | A61H 15/0092 | 601/120 |
| 4,807,603 | A * | 2/1989 | Yasui | A61H 15/00 | 601/121 |
| 5,830,161 | A * | 11/1998 | Cosmano | A61H 15/00 | 601/121 |
| 6,499,485 | B1 * | 12/2002 | Pepera | A61F 7/02 | 128/845 |
| 6,974,427 | B1 * | 12/2005 | Lapham | A61H 15/00 | 601/120 |
| 7,250,032 | B2 * | 7/2007 | Fink | A61H 1/0292 | 601/118 |
| D563,557 | S * | 3/2008 | Fink | D24/200 | |
| D567,951 | S * | 4/2008 | Fink | D24/200 | |
| D567,953 | S * | 4/2008 | Fink | D24/200 | |
| D700,346 | S * | 2/2014 | Palizzi | D24/211 | |
| D700,709 | S * | 3/2014 | Khodabakhshian | D24/211 | |
| D736,398 | S * | 8/2015 | Kwon | D24/211 | |
| 2015/0133271 | A1 * | 5/2015 | Jones | A61H 15/00 | 482/51 |
| 2015/0133835 | A1 * | 5/2015 | Fadil | A61H 15/0092 | 601/118 |
| 2016/0030801 | A1 * | 2/2016 | Porto | A61H 15/0092 | 482/139 |
| 2016/0331580 | A1 * | 11/2016 | Chen | A61F 7/00 | |

* cited by examiner

MASSAGE AND EXERCISE ROLLER

The current application claims a priority to the U.S. Provisional Patent application Ser. No. 62/214,491 filed on Sep. 4, 2015.

FIELD OF THE INVENTION

The present invention relates generally to an apparatus that utilizes self-myofascial and connective tissue release induced by foam rolling to aid in recovery of muscles that are prone to being overactive or stressed and also to increase blood flow in tissues which increases oxygen and nutrient absorption. In particular, the present invention utilizes a cylindrically shaped body with ellipsoid protrusions of various curvatures optimized for human anatomy, a selective density, and a selective diameter to optimize the myofascial and connective tissue release of an individual body parts.

BACKGROUND OF THE INVENTION

Foam Rolling is a self-myofascial and connective tissue release technique used to aid in recovery of muscles that are prone to being overactive. Fascia is the soft tissue portion of the connective tissue in the muscle that provides support and protection. Exercise induces micro-tears and swelling in muscle fibers, which impinge on nerves and vessels. Over time, this can develop into adhesions and scar tissue. Rolling and flexibility exercise helps smooth out these obstructions and break down adhesions, helping to increase blood-flow within the muscle and surrounding connective tissue.

Poor blood circulation and skeletal alignment are problems for many people which can cause pain, poor healing, reduced flexibility and range of motion, and numb cold legs, feet, hands, and arms. The present invention can be useful in stimulating body parts to help circulation and correct alignment problems. There exist today a number of apparatus for blood circulation stimulation and alignment. The disadvantages with these apparatuses are that they do not work connective tissues at the correct angles, cannot reach areas because of our skeletal structure, only exercise and massage limited body parts efficiently, can be difficult to operate, and do not provide satisfactory outcomes and results.

It is thus the object of the present invention to provide a simple apparatus that is new and improved with multiple curvatures, easy to operate and that treats the patient in an effective and time efficient way, to stimulate blood vessels and to improve blood circulation over time thereby promoting the flow of blood to add oxygen and nutrients for muscle and connective tissue ailment and to improve the quality of life of the person. Furthermore, the multiple curvatures of the present invention enable a user to control massage of connective tissue at oblique angles. These angles avoid boney structures and contour muscle groups to avoid the pinching of tissues and nerves.

DETAIL DESCRIPTIONS OF THE INVENTION

Figure 1:
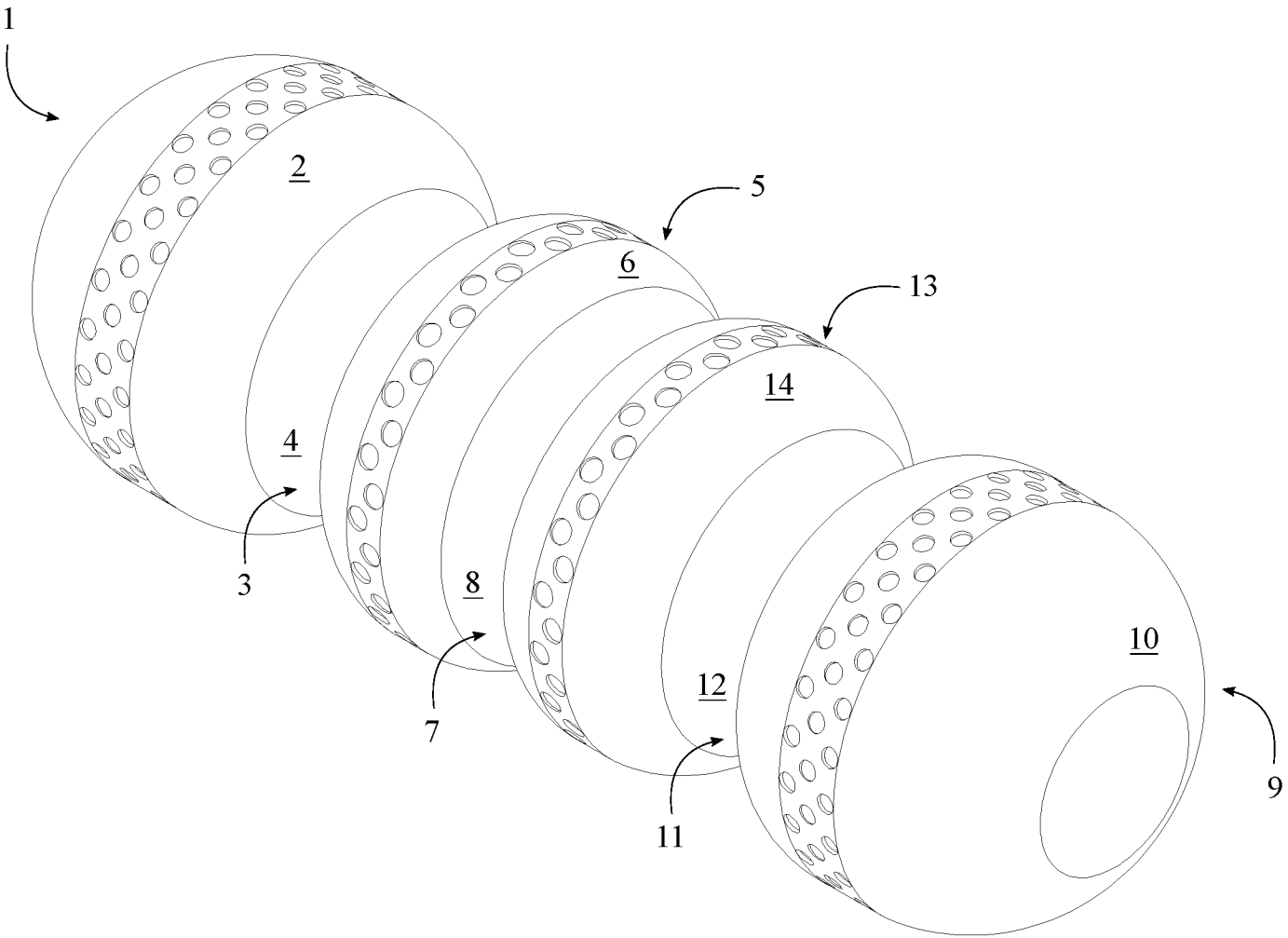
FIG. 1 is a perspective view of the present invention.

All illustrations of the drawings are for the purpose of describing selected versions of the present invention and are not intended to limit the scope of the present invention.

The present invention is an efficient, effective, and comfortable connective therapy foam roller apparatus that is made to fit the user's body. The present invention includes contact zones and cradling zones that are optimized for entire body of the user and distinct area of body parts of the user. The contact zones provide stability during rolling, myofascial release, trigger point therapy, maximizes usefulness and therapeutic benefits, and alignment of the spine. The cradling zones speed up the rolling process while targeting the respective body parts. For example, natural contours of the contact zones and the cradling zones wrap and fit around bones like the tibia, spine, pelvis, and muscles to provide myofascial release in comparison to a flat rolling apparatus. The present invention is suitable to be used on all of the surfaces of the human body. In addition to being suitable for use on the front and the back of the human body, the present invention can also be used for myofascial release of sacroiliac joints and the iliac or sides of the hips at the same time. In reference to FIG. 1-2, the present invention comprises a left-end roller section 1, a left myofascial release (MFR) section 3, a left-intermediate roller section 5, a central MFR section 7, a right-end roller section 9, a right MFR section 11, and a right-intermediate roller section 13. More specifically, the left-end roller section 1, the left MFR section 3, the left-intermediate roller section 5, the central MFR section 7, the right-intermediate roller section 13, the right MFR section 11, and the right-end roller section 9 are axially positioned along a central axis 15 and a sagittal plane 16. In order to provide a symmetrical body for the present invention, the left-end roller section 1, the left MFR section 3, and the left-intermediate roller section 5 are oppositely positioned of the right-end roller section 9, the right MFR section 11, and the right-intermediate roller section 13 about the central MFR section 7.

Figure 2:
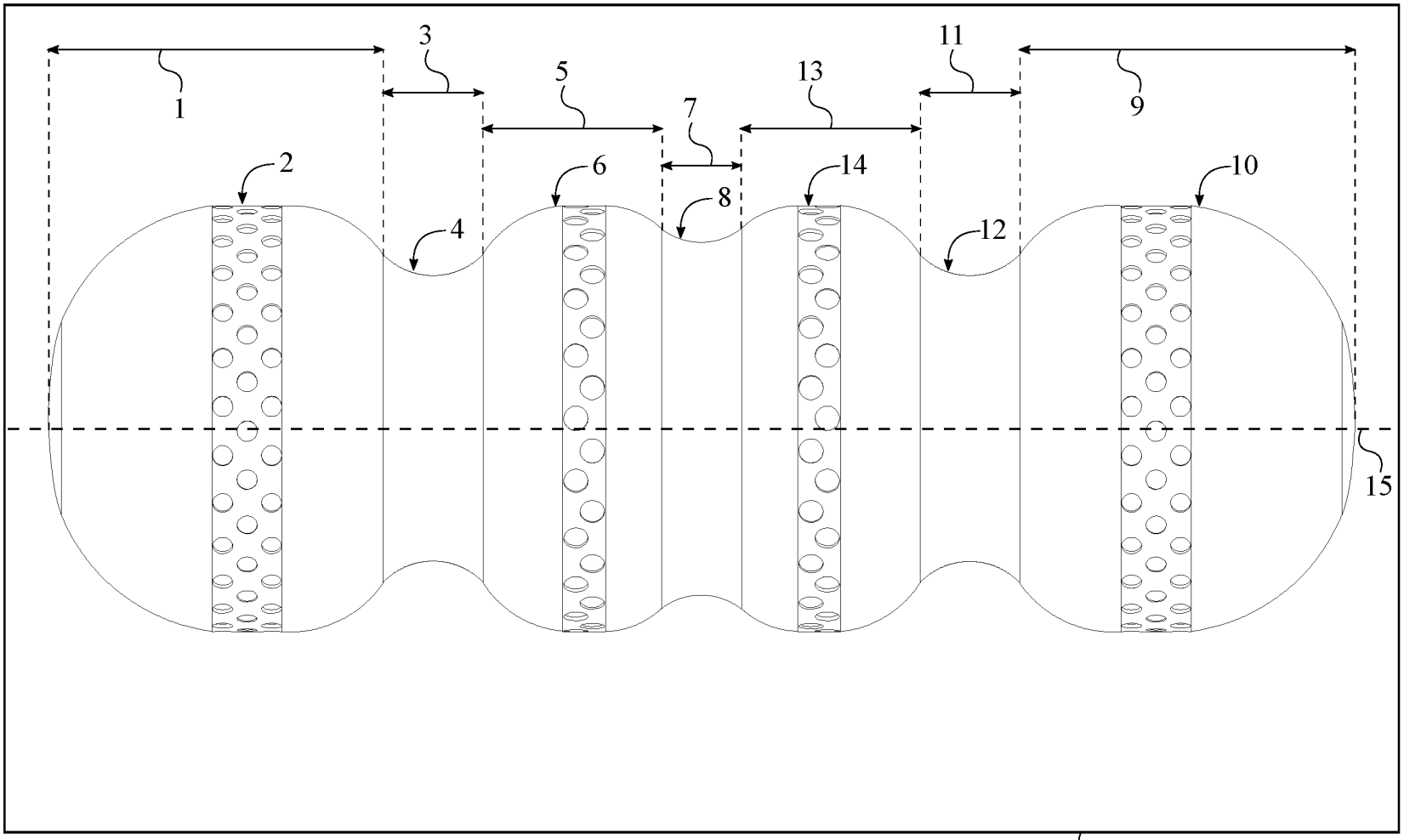
FIG. 2 is a front view of the present invention, showing different roller sections and lateral surfaces.

In reference to FIG. 1-2, a single body with contact zones and cradling zones are formed within the present invention by the aforementioned components. More specifically, the left-end roller section 1 is perimetrically connected with the left MFR section 3, wherein the present invention provides a continuous curvature from the left-end roller section 1 to the left MFR section 3. The left MFR section 3 is perimetrically connected with the left-intermediate roller section 5 and is positioned opposite of the left-end roller section 1. The present invention maintains the continuous curvature from the left-end roller section 1 to the left-intermediate roller section 5 through the left MFR section 3. As a result, the left-end roller section 1, the left MFR section 3, and the left-intermediate roller section 5 complete the left side of the present invention. The left-intermediate roller section 5 is perimetrically connected with the central MFR section 7, opposite of the left MFR section 3 in order to maintain the continuous curvature. The central MFR section 7 functions as the connecting member between the left side and the right side of the present invention. The right-end roller section 9 is perimetrically connected with the right MFR section 11. The present invention is able to provide a continuous curvature from the right-end roller section 9 to the right MFR section 11. The right MFR section 11 is perimetrically connected with the right-intermediate roller section 13 and is positioned opposite of the right-end roller section 9. The present invention maintains the continuous curvature from the right-end roller section 9 to the right-intermediate roller section 13 through the right MFR section 11. As a result, the right-end roller section 9, the right MFR section 11, and the right-intermediate roller section 13 are able to complete the right side of the present invention. The right-intermediate roller section 13 is perimetrically connected with the central MFR section 7, opposite of the right MFR section 11, so that the present invention is able to maintain the continuous curvature from the left-end roller section 1 to the left-end roller section 9.

In reference to FIG. 1-2, the left-end roller section 1 and the right-end roller section 9 function as outer alignment ellipsoid bodies of the present invention. The left-end roller section 1 and the right-end roller section 9 have a circular cross-section in the longitudinal direction and an elliptical cross-section in the horizontal direction or about the sagittal plane 16. The left-end roller section 1 and the right-end roller section 9 provide stability and a variety of curvatures that are designed for connective tissue and trigger point therapy.

In reference to FIG. 1-2, the left-intermediate roller section 5 and the right-intermediate roller section 13 function as inner alignment ellipsoid bodies of the present invention. The left-intermediate roller section 5 and the right-intermediate roller section 13 have a circular cross-section in the longitudinal direction and an elliptical cross-section in the horizontal direction or about the sagittal plane 16. The left-intermediate roller section 5 and the right-intermediate roller section 13 share the same diameter and the longitudinal cross section of the left-end roller section 1 and the right-end roller section 9 but have a different horizontal cross section. The left-intermediate roller section 5 and the right-intermediate roller section 13 are sufficiently firmed to preserve their parallel position when exerted on by external forces. As a result, the left-intermediate roller section 5 and the right-intermediate roller section 13 are suitable to be used for spinal alignment therapy. For example, rolling the present invention on the back of the user body with the spinal column positioned between the left-intermediate roller section 5 and the right-intermediate roller section 13 can help in straightening any abnormal curvature of the spinal column. The encompassing property of the left-intermediate roller section 5 and the right-intermediate roller section 13 that can be used for spinal alignment treatment can also be used for cranial sacral release of the neck. These are just some examples of how the left-intermediate roller section 5 and the right-intermediate roller section 13 can be used to provide targeted therapy for specific parts of the human body.

In reference to FIG. 1-2, the left MFR section 3, the central MFR section 7, and the right MFR section 11 function as groove bodies of the present invention as each groove body arises from a pair of ellipsoid bodies. More specifically, the central MFR section 7 is formed by the negative space of the adjoining left-intermediate roller section 5 and the right-intermediate roller section 13. The negative space of the center MFR section 7 takes pressure off the spine and provides more comfort to the user body when the present invention is utilized. The left MFR section 3 is formed by the negative spaces of the joint between the left-end roller section 1 and the left-intermediate roller section 5. The right MFR section 11 is formed by the negative spaces of the joint between the right-end roller section 9 and the right-intermediate roller section 13. When the user exerts a tangential force on the left MFR section 3, the central MFR section 7, and the right MFR section 11, the smaller radius of the groove bodies in reference to the radius of the ellipsoid bodies, results in a high angular velocity. Thus the resultant angular velocity of the present invention is defined by the higher angular velocity of the groove bodies. The exaggerated concave lateral surfaces formed by the projecting ellipsoid bodies of the present invention result in a high surface area to volume ratio. This also results in a lower rolling time by increasing the surface area that the body parts may contact at any given time. The ellipsoid bodies also provide stability, proper alignment of body parts, bypass of bones to access areas of the body that could not release with ordinary round rollers, and contour muscle groups to avoid the pinching of tissues and nerves.

Figure 3:
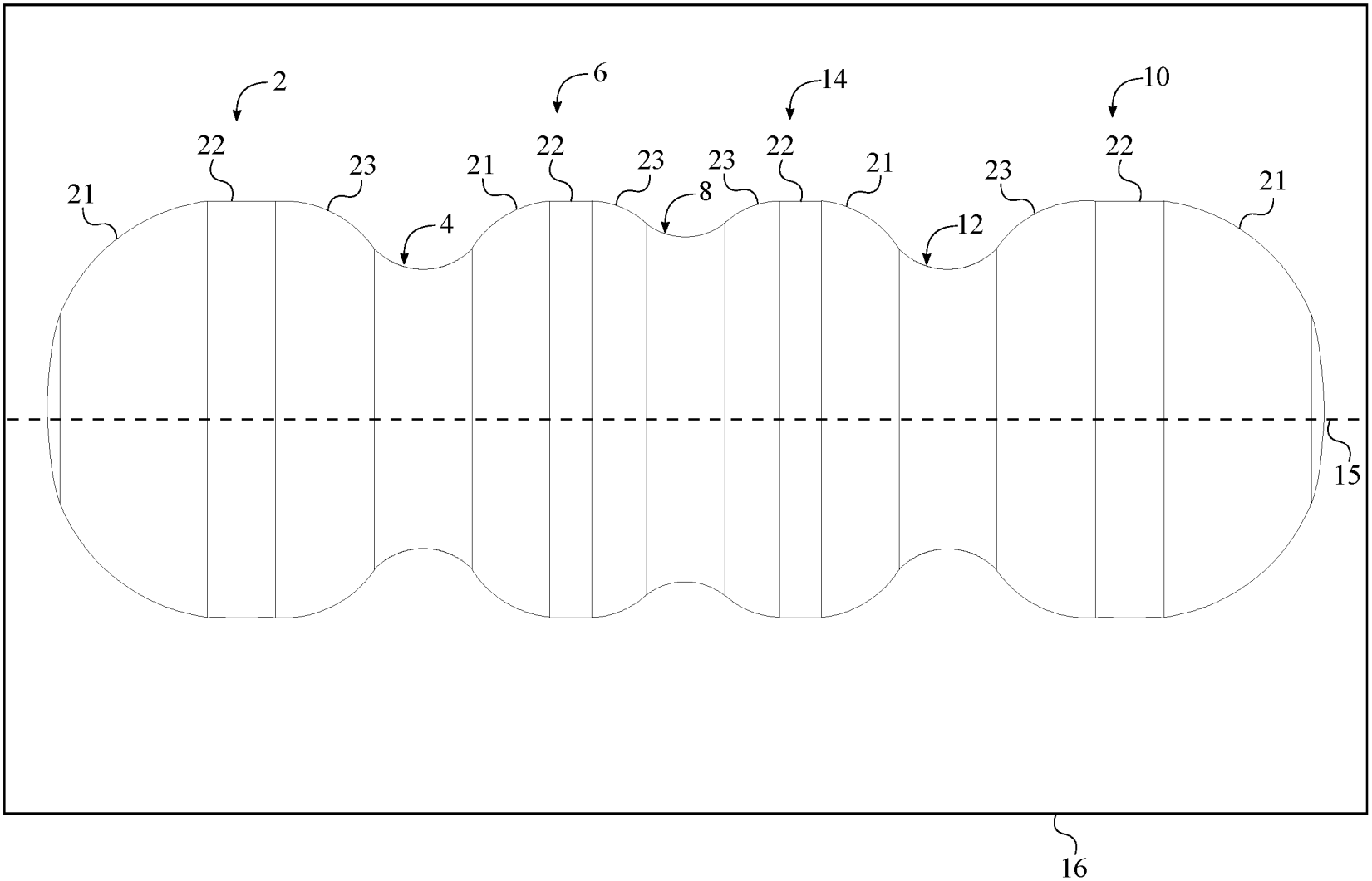
FIG. 3 is a front view of the present invention, showing different profiles and inflection edges.

In reference to FIG. 1-2, the present invention further comprises a left concave lateral surface 2 and a right concave lateral surface 10 that are respectively associated with the left-end roller section 1 and the right-end roller section 9. More specifically, the left concave lateral surface 2 is externally positioned around the left-end roller section 1 and the right concave lateral surface 10 is externally positioned around the right-end roller section 9. Due to the symmetrical characteristic of the present invention, the left concave lateral surface 2 and the right concave lateral surface 10 each comprises an increasing concave-down profile 21, a flat profile 22, and a decreasing concave-down profile 23 about the sagittal plane 16. In reference to FIG. 3, the increasing concave-down profile 21, the flat profile 22, and the decreasing concave-down profile 23 delineate the overall profile of the left concave lateral surface 2 and the right concave lateral surface 10.

Figure 4:
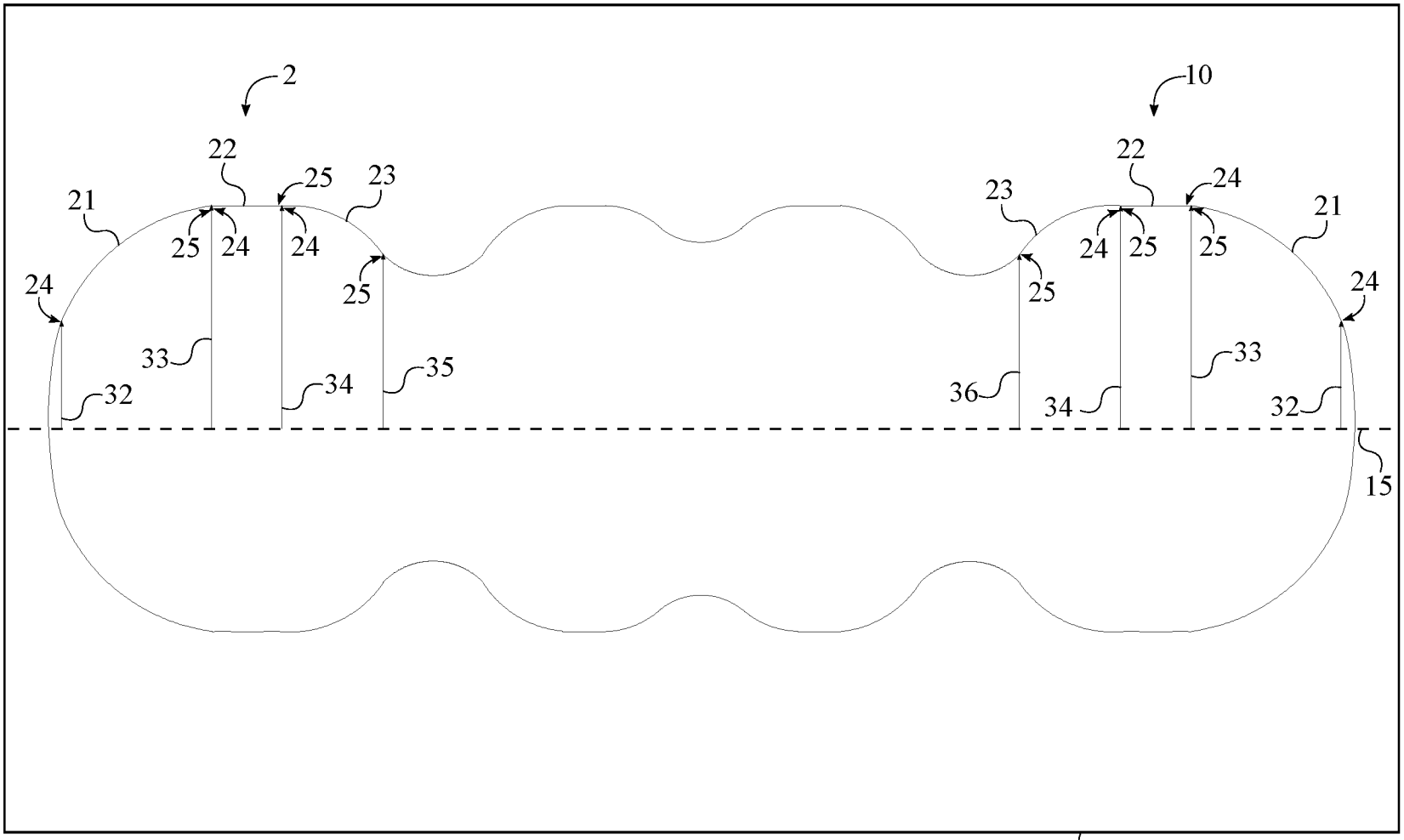
FIG. 4 is a front view of the present invention, showing the first radial distance, the second radial distance, the third radial distance, the fourth radial distance, and the fifth radial distance within the left-end roller section and the right-end roller section.

In order to properly illustrates the contours of the left concave lateral surface 2 and the right concave lateral surface 10 within the present invention, the increasing concave-down profile 21, the flat profile 22, and the decreasing concave-down profile 23 each comprises a first inflection edge 24 and a second inflection edge 25. Additionally, the present invention further comprises a first radial distance 32, a second radial distance 33, a third radial distance 34, a fourth radial distance 35, and a fifth radial distance 36. In reference to FIG. 4, the first inflection edge 24 of the increasing concave-down profile 21 is adjacently positioned with the central axis 15 delineating a starting point for the left concave lateral surface 2 and the right concave lateral surface 10. As a result, the first radial distance 32 extends from the first inflection edge 24 of the increasing concave-down profile 21 to the central axis 15. The second inflection edge 25 of the increasing concave-down profile 21 is adjacently positioned with the first inflection edge 24 of the flat profile 22 thus ending the increasing concave-down profile 21 and starting the flat profile 22. The second radial distance 33 extends from the second inflection edge 25 of the increasing concave-down profile 21 and the first inflection edge 24 of the flat profile 22 to the central axis 15. Furthermore, the second radial distance 33 is greater than the first radial distance 32 in order to illustrate the overall profile of the increasing concave-down profile 21. The second inflection edge 25 of the flat profile 22 is adjacently positioned with the first inflection edge 24 of the decreasing concave-down profile 23 thus ending the flat profile 22 and starting the decreasing concave-down profile 23. The third radial distance 34 extends from the second inflection edge 25 of the flat profile 22 and the first inflection edge 24 of the decreasing concave-down profile 23 to the central axis 15. Furthermore, the second radial distance 33 is equal to the third radial distance 34. The second inflection edge 25 of the decreasing concave-down profile 23 is adjacently positioned with both the left MFR section 3 and the right MFR section 11 thus ending the decreasing concave-down profile 23 and starting the left convex lateral surface 4 and the right convex lateral surface 12 respectively. The fourth radial distance 35 extends from the second inflection edge 25 of the decreasing concave-down profile 23 for the left concave lateral surface 2 to the central axis 15 delineating an ending point for the left concave lateral surface 2. The fifth radial distance 36 extends from the second inflection edge 25 of the decreasing concave-down profile 23 for the right concave lateral surface 10 to the central axis 15 delineating an ending point for the right concave lateral surface 10. Furthermore, the fifth radial distance 36 is equal to the fourth radial distance 35 while both the fifth radial distance 36 and the fourth radial distance 35 are shorter than the third radial distance 34.

Figure 5:
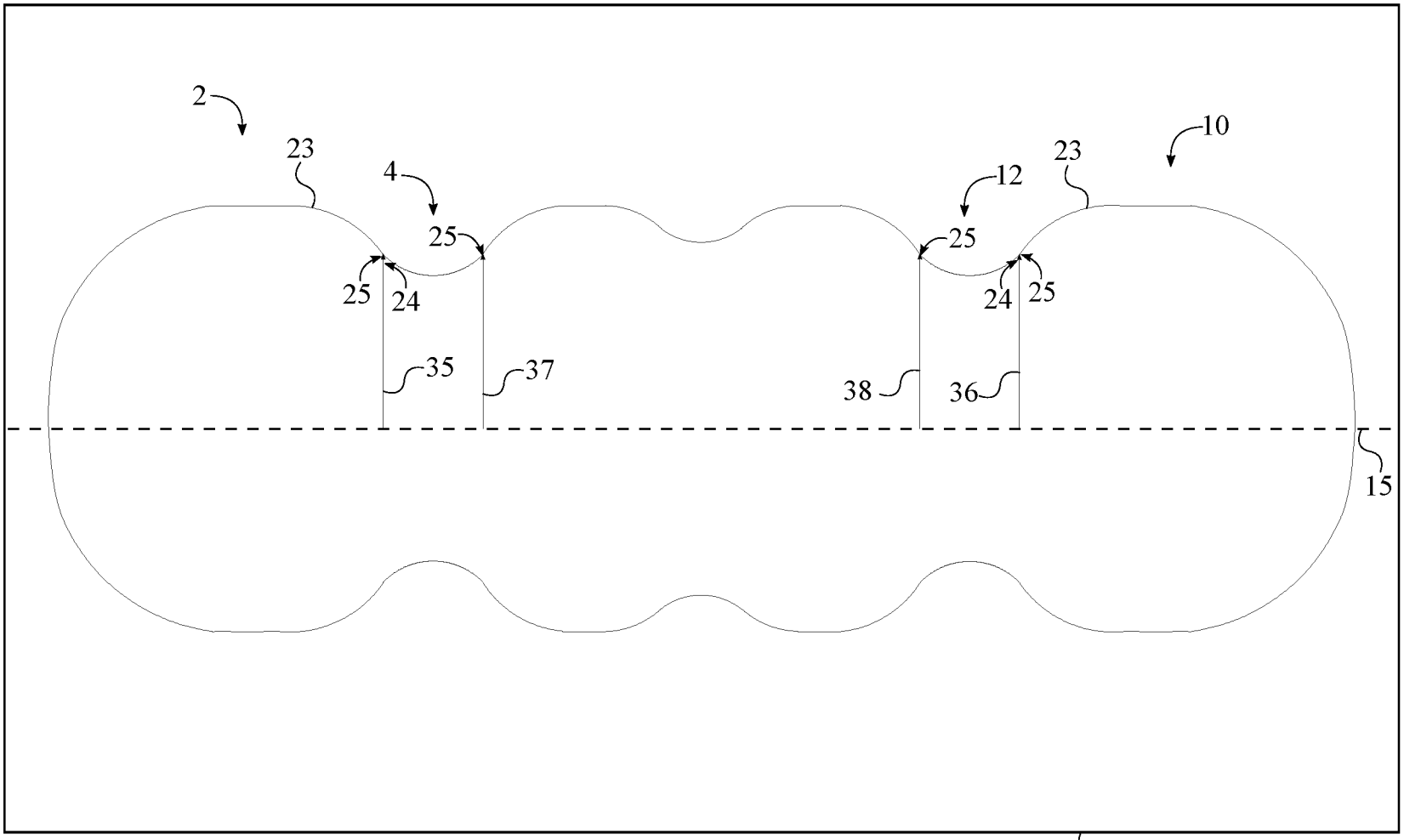
FIG. 5 is a front view of the present invention, showing the fourth radial distance, the fifth radial distance, the sixth radial distance, and the seventh radial distance within the MFR section and the right MFR section.

In reference to FIG. 1-2 and FIG. 5, the present invention further comprises a left convex lateral surface 4 and a right convex lateral surface 12 that are respectively associated with the left MFR section 3 and the right MFR section 11. More specifically, the left convex lateral surface 4 is externally positioned around the left MFR section 3 and the right convex lateral surface 12 is externally positioned around the right MFR section 11. Due to the symmetrical characteristic of the present invention, the left convex lateral surface 4 and the right convex lateral surface 12 each comprises a first inflection edge 24 and a second inflection edge 25. Additionally, the present invention further comprises a sixth radial distance 37 and a seventh radial distance 38. The first inflection edge 24 of the left convex lateral surface 4 is adjacently positioned with the second inflection edge 25 for the decreasing concave-down profile 23 of the left concave lateral surface 2 in order to continue the contour from the left side of the present invention. The first inflection edge 24 of the right convex lateral surface 12 is adjacently positioned with the second inflection edge 25 for the decreasing concave-down profile 23 of the right concave lateral surface 10 in order to continue the contour from the right side of the present invention. As a result, the fourth radial distance 35 is further clarified to be extended from the second inflection edge 25 for the decreasing concave-down profile 23 of the left concave lateral surface 2 and the first inflection edge 24 of the left convex lateral surface 4 to the central axis 15. Similarly, the fifth radial distance 36 is further clarified to be extended from the second inflection edge 25 for the decreasing concave-down profile 23 of the right concave lateral surface 10 and the first inflection edge 24 of the right convex lateral surface 12 to the central axis 15. The sixth radial distance 37 extends from the second inflection edge 25 of the left convex lateral surface 4 to the central axis 15, wherein the first inflection edge 24 and the second inflection edge 25 of the left convex lateral surface 4 respectively define a starting point and an ending point for the left convex lateral surface 4. The seventh radial distance 38 extends from the second inflection edge 25 of the right convex lateral surface 12 to the central axis 15, wherein the first inflection edge 24 and the second inflection edge 25 of the right convex lateral surface 12 respectively define a starting point and an ending point for the right convex lateral surface 12. In order to maintain symmetric contours of the present invention from the left side to right side, the fourth radial distance 35 is equal to the sixth radial distance 37 from left side while the fifth radial distance 36 is equal to the seventh radial distance 38 from the right side.

Figure 6:
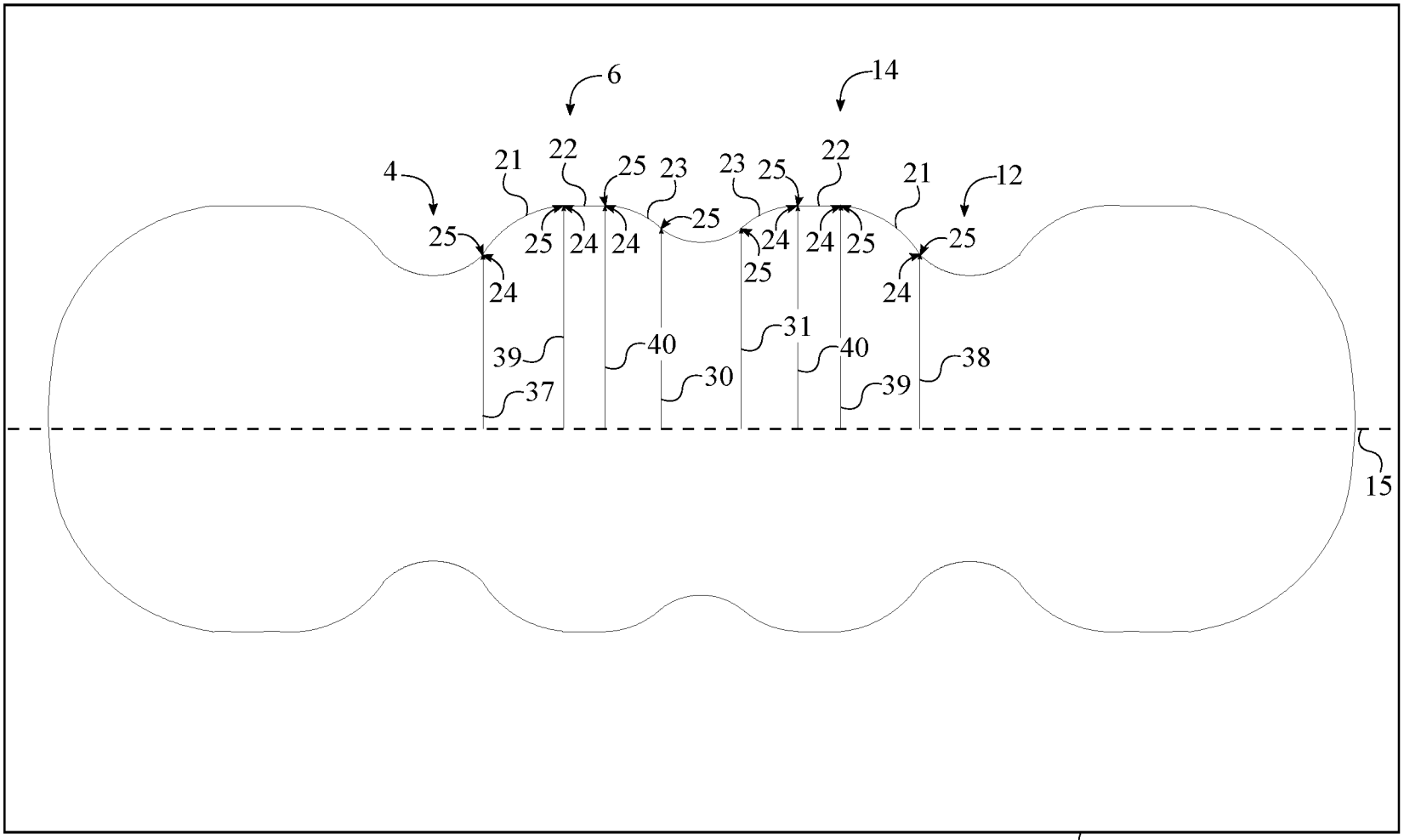
FIG. 6 is a front view of the present invention, showing the sixth radial distance, the seventh radial distance, the eighth radial distance, the ninth radial distance, the left radial distance, and the right radial distance within the left-intermediate roller section and the right-intermediate roller section.

In reference to FIG. 1-2, the present invention further comprises a left-intermediate concave lateral surface 6 and a right-intermediate concave lateral surface 14 that are respectively associated with the left-intermediate roller section 5 and the right-intermediate roller section 13. More specifically, the left-intermediate concave lateral surface 6 is externally positioned around the left-intermediate roller section 5 and the right-intermediate concave lateral surface 14 is externally positioned around the right-intermediate roller section 13. Due to the symmetrical characteristic of the present invention, the left-intermediate concave lateral surface 6 and the right-intermediate concave lateral surface 14 each comprises an increasing concave-down profile 21, a flat profile 22, and a decreasing concave-down profile 23 about the sagittal plane 16. In reference to FIG. 6, the increasing concave-down profile 21, the flat profile 22, and the decreasing concave-down profile 23 delineate the overall profile of the left-intermediate concave lateral surface 6 and the right-intermediate concave lateral surface 14.

In order to properly illustrates the contours of the left-intermediate concave lateral surface 6 and the right-intermediate concave lateral surface 14, the increasing concave-down profile 21, the flat profile 22, and the decreasing concave-down profile 23 each comprises a first inflection edge 24 and a second inflection edge 25. Additionally, the present invention further comprises an eighth radial distance 39, a ninth radial distance 40, a left radial distance 30, and a right radial distance 31. In reference to FIG. 6, the first inflection edge 24 of the increasing concave-down profile 21 the left-intermediate concave lateral surface 6 is adjacently positioned with the second inflection edge 25 of the left convex lateral surface 4 delineating a starting point for the left-intermediate concave lateral surface 6. As a result, the sixth radial distance 37 is further clarified to be extended from the second inflection edge 25 of the left convex lateral surface 4 and the first inflection edge 24 of the left-intermediate concave lateral surface 6 to the central axis 15. Similarly, the first inflection edge 24 of the increasing concave-down profile 21 for the right-intermediate concave lateral surface 14 is adjacently positioned with the second inflection edge 25 of the right convex lateral surface 12 delineating a starting point for the right-intermediate concave lateral surface 14. As a result, the seventh radial distance 38 is further clarified to be extended from the second inflection edge 25 of the right convex lateral surface 12 and the first inflection edge 24 of right-intermediate concave lateral surface 14 to the central axis 15. Additionally, the sixth radial distance 37 is equal to the seventh radial distance 38. The second inflection edge 25 of the increasing concave-down profile 21 is adjacently positioned with the first inflection edge 24 of the flat profile 22 thus ending the increasing concave-down profile 21 and starting the flat profile 22. The eighth radial distance 39 extends from the second inflection edge 25 of the increasing concave-down profile 21 and the first inflection edge 24 of the flat profile 22 to the central axis 15. Furthermore, the eighth radial distance 39 is greater than the sixth radial distance 37 and the seventh radial distance 38 in order to illustrates the overall profile of the increasing concave-down profile 21. The second inflection edge 25 of the flat profile 22 is adjacently positioned with the first inflection edge 24 of the decreasing concave-down profile 23 thus ending the flat profile 22 and starting the decreasing concave-down profile 23. The ninth radial distance 40 extends from the second inflection edge 25 of the flat profile 22 and the first inflection edge 24 of the decreasing concave-down profile 23 to the central axis 15. Furthermore, the ninth radial distance 40 is equal to the eighth radial distance 39. The second inflection edge 25 of the decreasing concave-down profile 23 is adjacently positioned with the central MFR section 7 thus ending the decreasing concave-down profile 23 and starting the central convex lateral surface 8 from the left side and the right side of the central MFR section 7. The left radial distance 30 extends from the second inflection edge 25 of the decreasing concave-down profile 23 for the left-intermediate concave lateral surface 6 to the central axis 15 delineating an ending point for the left-intermediate concave lateral surface 6. The right radial distance 31 extends from the second inflection edge 25 of the decreasing concave-down profile 23 for the right-intermediate concave lateral surface 14 to the central axis 15 delineating an ending point for the right-intermediate concave lateral surface 14. Furthermore, the left radial distance 30 is equal to the right radial distance 31 while both the left radial distance 30 and the right radial distance 31 are shorter than the ninth radial distance 40.

Figure 7:
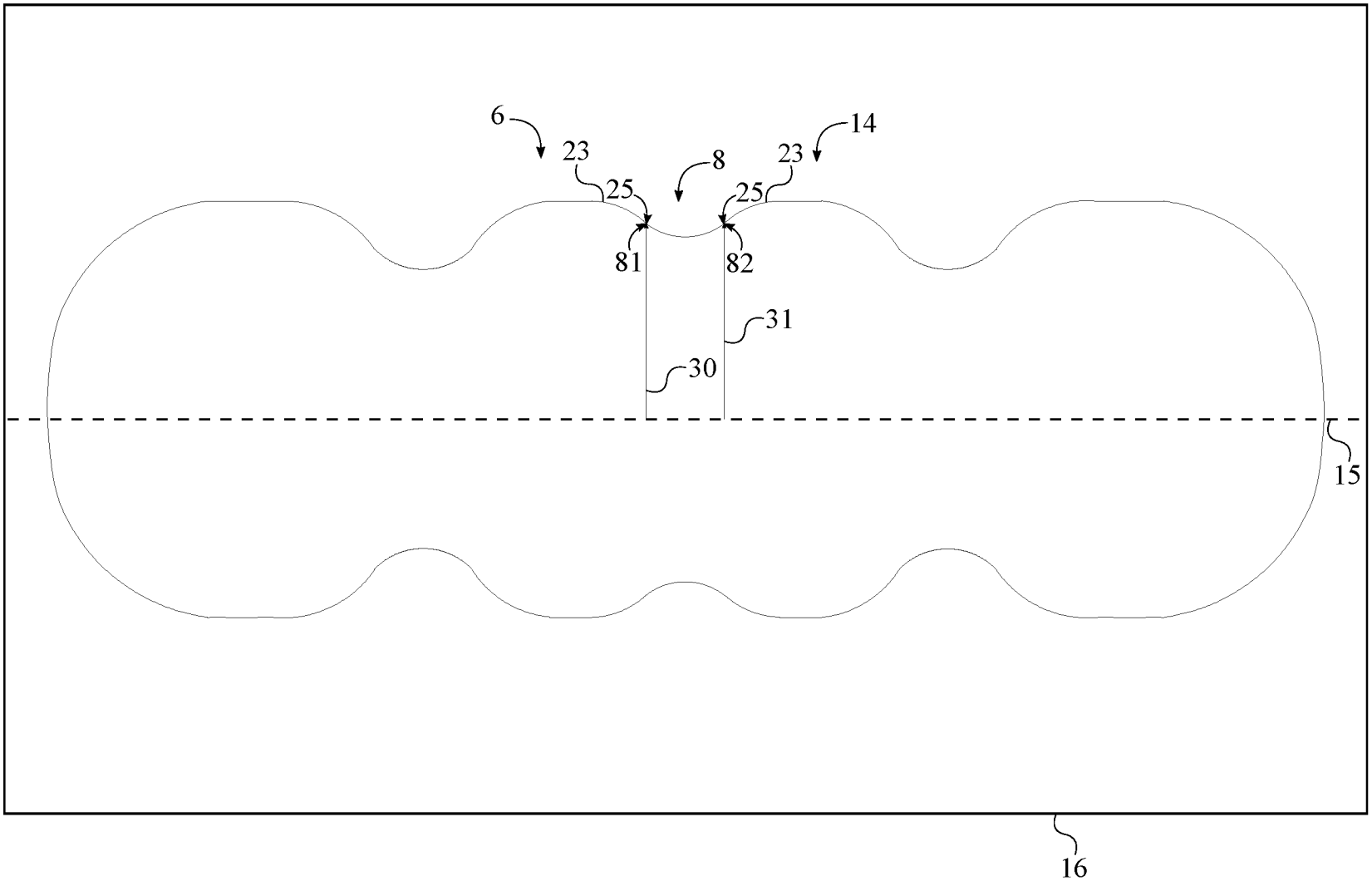
FIG. 7 is a front view of the present invention, showing the left radial distance and the right radial distance within the central MFR section.

In reference to FIG. 1-2 and FIG. 7, the present invention further comprises a central convex lateral surface 8 that is associated with the central MFR section 7. More specifically, the central convex lateral surface 8 is externally positioned around the central MFR. Due to the symmetrical characteristic of the present invention; the central convex lateral surface 8 comprises a left inflection edge 81 and a right inflection edge 83. The left inflection edge 81 of the central convex lateral surface 8 is adjacently positioned with the second inflection edge 25 for the decreasing concave-down profile 23 of the left-intermediate concave lateral surface 6 in order to continue the contour from the left side of the present invention. The right inflection edge 83 of the central convex lateral surface 8 is adjacently positioned with the second inflection edge 25 for the decreasing concave-down profile 23 of the right-intermediate concave lateral surface 14 in order to continue the contour from the right side of the present invention. The left radial distance 30 is further clarified to be extended from the left inflection edge 81 and the second inflection edge 25 for the decreasing concave-down profile 23 of the left-intermediate concave lateral surface 6 to the central axis 15. Similarly, the right radial distance 31 is further clarified to be extended from the right inflection edge 83 and the second inflection edge 25 for the decreasing concave-down profile 23 of the right-intermediate concave lateral surface 14 to the central axis 15. In order to maintain symmetric contours of the present invention from the left side and the right side of the central MFR section 7, the left radial distance 30 of the central convex lateral surface 8 is equal to the right radial distance 31 of the central convex lateral surface 8.

In addition to the aforementioned benefits, the present invention also provides therapeutic healing for chronic pains, neurofascial release therapy, myofascial pain syndrome (MPS) through myofascial release, back aches, spine alignments and adjustments, shin splints, shoulder therapy, knee and hip pain, PSOAS release, headaches, cranial release and neck/back adjustments, increase energy, decrease tension and anxiety, increase blood flow, increase oxygen & hydration of cells, plantar fasciitis/Foot aches and problems, and detoxifying.

It is the object of the present invention to mimic the natural feel of the palm of a human hand. As such the present invention is composed of a soft and flexible material such as EVA foam or equivalent. Alternate embodiments of the present invention may use a polymeric material to same effects. The materials can also be heated to change the density and hence the firmness. The alternative embodiments of the present invention may also utilize a myriad of tread patterns etched on the circumference of the left-end roller section 1, the left-intermediate roller section 5, the right-end roller section 9, and the right-intermediate roller section 13. The tread patterns can be a plurality of indentations that further presses onto the myofascial tissue of the user's body. Additionally, in the event of the present invention being composed of a material of a low friction coefficient, the user may feel uncomfortable if the left-end roller section 1, the left-intermediate roller section 5, the right-end roller section 9, and the right-intermediate roller section 13 fail to roll as they travel along the user's body. In this case, the tread patterns may also be used to supplement the frictional force between the left-end roller section 1, the left-intermediate roller section 5, the right-end roller section 9, and the right-intermediate roller section 13 and the user's body for ease of rotation when in operation.

Connective tissue refers to tissues that connect organs and systems and surround, protect and support all other structures in the body. Connective tissue, specifically fascia is often described as a 3D spider web of interconnected fibers. The fascia forms the largest system in the body and it touches all the other systems. Overuse, injury, illness, trauma, or stresses can all affect the fascia and lead to discomfort, stiffness, reduced flexibility, or pain in the body. Spinal alignment and tightness can be a cause of headaches because every part of our body is connected by this complex continuous web.

The left concave lateral surface 2, the right concave lateral surface 10, the left convex lateral surface 4, the right convex lateral surface 12, the left-intermediate concave lateral surface 6, the right-intermediate concave lateral surface 14, and the central convex lateral surface 8 allows the present invention to manipulate the fascia and connective tissue at oblique angles to skin thus providing release of adhesions that slow down repair of our bodies on a cellular level. The neurofascial layer stimulation by the respective oblique angle massage shows an increase in hydration thereby the skin appears softer and suppler. As a result, the present invention aids in connective therapy which is the process of stimulating the tissues that connect, support, and protect the organs and systems in the body to provide greater hydration, oxygenation and nutrition for healing, injury prevention, anti-aging and overall wellbeing.

An alternative embodiment of the present invention may include a removable handle that engages through a hole that extends longitudinally along the central axis 15 the present invention. A hollow cylindrical member occupies the hole and acts as a bearing that preserves the alignment of the handle. The handle itself is a generic handle made of rubber or another suitably light and durable material and comprises two grip structures located on the opposite ends of a long solid cylindrical member. The long solid cylindrical member fits loosely into the hollow cylindrical member. The handle further comprises a built-in bearing that preserve their longitudinal location within the body of the present invention and indentations that encase the contours of the fingers.

The long solid cylindrical member and the hollow cylindrical member are both preferably made of a polymeric material with a low coefficient of friction so that the friction generated by the two components coming into physical contact with each other doesn't impede the rotation of the present invention. The handle can be utilized for rolling the present invention without the need of an abutment such as the floor or the wall. For example, the handle can also be used for assisted rolling by another person on the user's body.

Another alternative embodiment of the present invention, the handle may utilize a different mechanism to achieve the same effects. For example, the handle may utilize a slot fastened to the surfaces of the left-end roller section 1 and the right-end roller section 9 and outsized protrusions projecting from the grip structures to create a snap engagement via an incongruous fit of the mating components. In yet another alternative embodiment of the present invention, the handle may utilize a fastening member such as a screw or a bolt to engage the grip structures to the left-end roller section 1 and the right-end roller section 9. Any and all methods that allow independent rotation of the body of the present invention with respect to the handle is suitable for use.

Although the invention has been explained in relation to its preferred embodiment, it is to be understood that many other possible modifications and variations can be made without departing from the spirit and scope of the invention as hereinafter claimed.

What is claimed is:

1. A massage and exercise roller comprising:

a left-end roller section;

a left myofascial release (MFR) section;

a left-intermediate roller section;

a central MFR section;

a right-end roller section;

a right MFR section;

a right-intermediate roller section;

the left-end roller section, the left MFR section, the left-intermediate roller section, the central MFR section, the right-intermediate roller section, the right MFR section and the right-end roller section being axially positioned along a central axis and a sagittal plane;

the left-end roller section, the left MFR section and the left-intermediate roller section being oppositely positioned of the right-end roller section, the right MFR section and the right-intermediate roller section about the central MFR section;

the left-end roller section being perimetrically connected with the left MFR section;

the left MFR section being perimetrically connected with the left-intermediate roller section;

the left-intermediate roller section being perimetrically connected with the central MFR section;

the right-end roller section being perimetrically connected with the right MFR section;

the right MFR section being perimetrically connected with the right-intermediate roller section;

the right-intermediate roller section being perimetrically connected with the central MFR section;

the left MFR section being connected in between the left-end roller section and the left-intermediate roller section;

the right MFR section being connected in between the right-end roller section and the right-intermediate roller section;

the central MFR section being connected in between the left-intermediate roller section and the right-intermediate roller section;

a left concave lateral surface;

a right concave lateral surface;

the left concave lateral surface being externally positioned around the left-end roller section;

the right concave lateral surface being externally positioned around the right-end roller section;

a left convex lateral surface;

a right convex lateral surface;

the left convex lateral surface being externally positioned around the left MFR section;

the right convex lateral surface being externally positioned around the right MFR section;

a left-intermediate concave lateral surface;

a right-intermediate concave lateral surface;

the left-intermediate concave lateral surface being externally positioned around the left-intermediate roller section;

the right-intermediate concave lateral surface being externally positioned around the right-intermediate roller section;

a central convex lateral surface;

the central convex lateral surface being externally positioned around the central MFR section;

the left concave lateral surface, the right concave lateral surface, the left-intermediate concave lateral surface and the right-intermediate concave lateral surface each comprising an increasing concave-down profile, a flat profile and a decreasing concave-down profile about the sagittal plane, the increasing concave-down profile, the flat profile and the decreasing concave-down profile each comprising a first inflection edge and a second inflection edge;

the first inflection edge of the increasing concave-down profile of the left concave lateral surface and the first inflection edge of the increasing concave-down profile of the right concave lateral surface each being adjacently positioned with the central axis;

the second inflection edge of the increasing concave-down profile of the left concave lateral surface being adjacently positioned with the first inflection edge of the flat profile of the left concave lateral surface;

the second inflection edge of the increasing concave-down profile of the right concave lateral surface being adjacently positioned with the first inflection edge of the flat profile of the right concave lateral surface;

the second inflection edge of the flat profile of the left concave lateral surface being adjacently positioned with the first inflection edge of the decreasing concave-down profile of the left concave lateral surface;

the second inflection edge of the flat profile of the right concave lateral surface being adjacently positioned with the first inflection edge of the decreasing concave-down profile of the right concave lateral surface;

the second inflection edge of the increasing concave-down profile of the left-intermediate concave lateral surface being adjacently positioned with the first inflection edge of the flat profile of the left-intermediate concave lateral surface;

the second inflection edge of the increasing concave-down profile of the right-intermediate concave lateral surface being adjacently positioned with the first inflection edge of the flat profile of the right-intermediate concave lateral surface;

the second inflection edge of the flat profile of the left-intermediate concave lateral surface being adjacently positioned with the first inflection edge of the decreasing concave-down profile of the left-intermediate concave lateral surface;

the second inflection edge of the flat profile of the right-intermediate concave lateral surface being adjacently positioned with the first inflection edge of the decreasing concave-down profile of the right-intermediate concave lateral surface;

the left convex lateral surface, the right convex lateral surface and the central convex lateral surface each comprising a left inflection edge and a right inflection edge;

the left inflection edge of the left convex lateral surface being adjacently positioned with the second inflection edge of the decreasing concave-down profile of the left concave lateral surface;

the right inflection edge of the right convex lateral surface being adjacently positioned with the second inflection edge of the decreasing concave-down profile of the right concave lateral surface;

the right inflection edge of the left convex lateral surface being adjacently positioned with the first inflection edge of the increasing concave-down profile of the left-intermediate concave lateral surface;

the left inflection edge of the right convex lateral surface being adjacently positioned with the first inflection edge of the increasing concave-down profile of the right-intermediate concave lateral surface;

the left inflection edge of the central convex lateral surface being adjacently positioned with the second inflection edge of the decreasing concave-down profile of the left-intermediate concave lateral surface;

the right inflection edge of the central convex lateral surface being adjacently positioned with the second inflection edge of the decreasing concave-down profile of the right-intermediate concave lateral surface;

a first left radial distance;

a first right radial distance;

the first left radial distance being extended from the left inflection edge of the central convex lateral surface and the second inflection edge of the decreasing concave-down profile of the left-intermediate concave lateral surface to the central axis;

the first right radial distance being extended from the right inflection edge of the central convex lateral surface and the second inflection edge of the decreasing concave-down profile of the right-intermediate concave lateral surface to the central axis;

the first left radial distance and the first right radial distance being equal to each other;

a second left radial distance;

a second right radial distance;

the second left radial distance being extended from the second inflection edge of the decreasing concave-down profile of the left concave lateral surface and the left inflection edge of the left convex lateral surface to the central axis;

the second right radial distance being extended from the right inflection edge of the left convex lateral surface and the first inflection edge of the increasing concave-down profile of the left-intermediate concave lateral surface to the central axis;

a third left radial distance;

a third right radial distance;

the third left radial distance being extended from the first inflection edge of the increasing concave-down profile of the right-intermediate concave lateral surface and the left inflection edge of the right convex lateral surface to the central axis;

the third right radial distance being extended from the right inflection edge of the right convex lateral surface and the second inflection edge of the decreasing concave-down profile of the right concave lateral surface to the central axis;

the second left radial distance, the second right radial distance, the third left radial distance and the third right radial distance being equal to each other; and each of the second left radial distance, the second right radial distance, the third left radial distance and the third right radial distance being shorter than each of the first left radial distance and the first right radial distance.

2. The massage and exercise roller as claimed in claim 1 comprising:

a fourth left radial distance;

a fourth right radial distance;

the fourth left radial distance being extended from the second inflection edge of the increasing concave-down profile of the left concave lateral surface and the first inflection edge of the flat profile of the left concave lateral surface to the central axis;

the fourth right radial distance being extended from the second inflection edge of the flat profile of the left concave lateral surface and the first inflection edge of the decreasing concave-down profile of the left concave lateral surface to the central axis;

a fifth left radial distance;

a fifth right radial distance;

the fifth left radial distance being extended from the second inflection edge of the flat profile of the right concave lateral surface and the first inflection edge of the decreasing concave-down profile of the right concave lateral surface to the central axis;

the fifth right radial distance being extended from the second inflection edge of the increasing concave-down profile of the right concave lateral surface and the first inflection edge of the flat profile of the right concave lateral surface to the central axis;

a sixth left radial distance;

a sixth right radial distance;

the sixth left radial distance being extended from the second inflection edge of the increasing concave-down profile of the left-intermediate concave lateral surface and the first inflection edge of the flat profile of the left-intermediate concave lateral surface to the central axis;

the sixth right radial distance being extended from the second inflection edge of the flat profile of the left-intermediate concave lateral surface and the first inflection edge of the decreasing concave-down profile of the left-intermediate concave lateral surface to the central axis;

a seventh left radial distance;

a seventh right radial distance;

the seventh left radial distance being extended from the second inflection edge of the flat profile of the right-intermediate concave lateral surface and the first inflection edge of the decreasing concave-down profile of the right-intermediate concave lateral surface to the central axis;

the seventh right radial distance being extended from the second inflection edge of the increasing concave-down profile of the right-intermediate concave lateral surface and the first inflection edge of the flat profile of the right-intermediate concave lateral surface to the central axis;

the fourth left radial distance, the fourth right radial distance, the fifth left radial distance, and the fifth radial distance being equal to each other, and wherein the sixth left radial distance, the sixth right radial distance, the seventh left radial distance and the seventh right radial distance being equal to each other;

an eighth left radial distance;

an eighth right radial distance;

the eighth left radial distance being extended from the first inflection edge of the increasing concave-down profile of the left concave lateral surface to the central axis;

the eighth right radial distance being extended from the first inflection edge of the increasing concave-down profile of the right concave lateral surface to the central axis;

the eighth left radial distance and the eighth right radial distance being equal to each other;

each of the eighth left radial distance and the eighth right radial distance being shorter than each of the second left radial distance, the second right radial distance, the third left radial distance and the third right radial distance; and each of the first left radial distance and the first right radial distance being shorter than each of the fourth left radial distance, the fourth right radial distance, the fifth left radial distance, the fifth right radial distance, the sixth left radial distance, the sixth right radial distance, the seventh left radial distance and the seventh right radial distance.

* * * * *